US008482199B2

(12) United States Patent
Hwang et al.

(10) Patent No.: US 8,482,199 B2
(45) Date of Patent: Jul. 9, 2013

(54) PLASMA DISPLAY PANEL CHARACTERIZED BY HIGH EFFICIENCY

(75) Inventors: Eui-Jeong Hwang, Yongin-si (KR); Hyoung-Bin Park, Yongin-si (KR); Sang-Ho Jeon, Yongin-si (KR); Seung-Hyun Son, Yongin-si (KR); Hyun-Chul Kim, Yongin-si (KR); Hyeon-Seok Kim, Yongin-si (KR); Bok-Chun Yun, Yongin-si (KR); Sil-Keun Jeong, Yongin-si (KR); Jung-Min Kim, Yongin-si (KR); Sung-Hyun Choi, Yongin-si (KR); Sang-Hyuck Ahn, Yongin-si (KR); Sung-Hee Cho, Yongin-si (KR); Gi-Young Kim, Yongin-si (KR); Myoung-Sup Kim, Yongin-si (KR); Hye-Jung Lee, Yongin-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 127 days.

(21) Appl. No.: 12/851,850

(22) Filed: Aug. 6, 2010

(65) Prior Publication Data

US 2011/0050095 A1 Mar. 3, 2011

(30) Foreign Application Priority Data

Aug. 28, 2009 (KR) ..... 10-2009-0080697

(51) Int. Cl.
*H01J 17/49* (2006.01)

(52) U.S. Cl.
USPC ..... 313/582; 313/583; 313/584; 313/292

(58) Field of Classification Search
USPC ..... 313/582–587, 292, 609, 607
See application file for complete search history.

(56) References Cited

U.S. PATENT DOCUMENTS

| | | | | |
|---|---|---|---|---|
| 7,176,852 | B2 | 2/2007 | Tachibana et al. | |
| 7,271,538 | B2 | 9/2007 | Sugimoto et al. | |
| 7,330,165 | B2 | 2/2008 | Tachibana et al. | |
| 7,342,558 | B2 | 3/2008 | Tachibana et al. | |
| 7,348,937 | B2 | 3/2008 | Tachibana et al. | |
| 7,378,796 | B2 | 5/2008 | Fujitani et al. | |
| 2005/0225231 | A1 * | 10/2005 | Park et al. | 313/501 |

(Continued)

FOREIGN PATENT DOCUMENTS

| | | |
|---|---|---|
| JP | 08-167380 | 6/1996 |
| JP | 2003-031130 | 1/2003 |
| JP | 2004-342447 | 12/2004 |
| KR | 10-2003-0013990 | 2/2003 |

*Primary Examiner* — Anh Mai
*Assistant Examiner* — Kevin Quarterman
(74) *Attorney, Agent, or Firm* — Robert E. Bushnell, Esq.

(57) ABSTRACT

A plasma display panel (PDP) comprises: a front substrate and a rear substrate which face each other; and a barrier wall which is interposed between the front substrate and the rear substrate, which includes base portions arranged on either side of a main discharge space, and protruding portions protruding on the base portions, respectively, and which defines stepped spaces on either side of the main discharge space. The stepped spaces are formed according to stepped surfaces formed by the base portions and the protruding portions. The PDP further comprises a pair of a scan electrode and a sustain electrode which generate a mutual discharge through the main discharge space. A channel space is defined by outer walls of the protruding portions on either side of the main discharge space, and an external light absorbing layer covers the channel space.

11 Claims, 5 Drawing Sheets

U.S. PATENT DOCUMENTS

2006/0279214 A1* 12/2006 Fujitani et al. ..... 313/587
2007/0262717 A1 11/2007 Ohta et al.
2008/0106197 A1* 5/2008 Song ..... 313/582
2009/0128035 A1* 5/2009 Nam et al. ..... 313/585
2009/0128036 A1* 5/2009 Kim ..... 313/586
2009/0140653 A1* 6/2009 Son ..... 313/582
2010/0117512 A1* 5/2010 Son et al. ..... 313/484
2010/0117513 A1* 5/2010 Son et al. ..... 313/484
2011/0068677 A1* 3/2011 Cho et al. ..... 313/485

* cited by examiner

PLASMA DISPLAY PANEL CHARACTERIZED BY HIGH EFFICIENCY

CLAIM OF PRIORITY

This application makes reference to, incorporates the same herein, and claims all benefits accruing under 35 U.S.C. §119 from an application earlier filed in the Korean Intellectual Property Office on Aug. 28, 2009 and there duly assigned Serial No. 10-2009-0080697.

BACKGROUND OF THE INVENTION

1. Field of the Invention

The present invention relates to a plasma display panel (PDP) and, more particularly to a highly efficient PDP which can be driven with low power and obtain high luminous brightness.

2. Description of the Related Art

Plasma display panels (PDPs) are a type of flat display devices that form images by using visible light produced from a phosphor material excited with ultraviolet (UV) rays generated by a plasma discharge.

In the PDPs, a front substrate having discharge electrodes arranged thereon and a rear substrate having address electrodes arranged thereon are attached to each other so as to face each other by interposing a plurality of barrier walls defining a plurality of discharge cells between the front and rear substrates. Then, a discharge gas is injected between the two substrates, and a phosphor material coating the discharge cells is excited by applying a discharge voltage between the discharge electrodes. Then, images are formed using visible light generated as a result of the excitation.

In the related art, a large portion of a phosphor layer is attached to side surfaces of the barrier walls. Because flowable phosphor paste sags and flows down from the side surfaces of the barrier walls, the phosphor layer is not formed with a sufficiently large and uniform thickness. In addition, the visible light generated from the phosphor layer is not emitted in an upward display direction, but rather it is emitted in the side surface direction of the barrier walls. Consequently, visible light extraction efficiency is low. Furthermore, since bottom surfaces of the discharge cells on which the phosphor material is concentrated are relatively far from the front substrate where the discharge electrodes are arranged, a sufficient amount of UV light does not reach the phosphor layer and thus fails to effectively excite the phosphor layer. Since an address discharge occurs along a long discharge path corresponding to the height of a discharge cell, a high address driving voltage is required, and a sufficient voltage margin is not obtained.

SUMMARY OF THE INVENTION

One or more embodiments of the present invention include a highly efficient plasma display panel (PDP) which can be driven with low power and obtain high luminous brightness.

Additional aspects will be set forth in part in the description which follows and, in part, will be apparent from the description, or may be learned by practice of the presented embodiments.

According to one or more embodiments of the present invention, a PDP includes a front substrate and a rear substrate which face each other; a barrier wall which is interposed between the front substrate and the rear substrate, which includes base portions arranged on either side of a main discharge space and protruding portions protruding on the base portions, respectively, and which defines stepped spaces on either side of the main discharge space, wherein the stepped spaces are formed according to stepped surfaces formed by the base portions and the protruding portions; a pair of a scan electrode and a sustain electrode which generate a mutual discharge through the main discharge space; a channel space which is defined by outer walls of the protruding portions on either side of the main discharge space; and an external light absorbing layer which covers the channel space.

The stepped spaces disposed on either side of the main discharge space may be connected to the main discharge space so as to form a single unit cell, and the channel space may be formed between adjacent unit cells. The channel space may be defined by adjacent protruding portions between adjacent unit cells.

The external-light absorbing layer may be disposed between the protruding portions which define the channel space.

The external-light absorbing layer may extend to areas over the stepped spaces via areas over the protruding portions, and a width corresponding to an extension of the external-light absorbing layer, which starts from each protruding portion, may be restricted to be 5 μm or less.

The barrier wall may include a horizontal barrier wall including the base portions and the protruding portions elongated in one direction, and a vertical barrier wall elongated so as to cross the direction in which the horizontal barrier walls are elongated. The channel space may be formed between adjacent horizontal barrier walls.

The scan electrode and the sustain electrode may include transparent electrodes and bus electrodes connected to the transparent electrodes, respectively. Ends of the external-light absorbing layer may be aligned with ends of the bus electrodes.

The PDP may further include an address electrode which generates an address discharge together with the scan electrode, and which is elongated to cross an elongation direction of the scan electrode, wherein the scan electrode and the address electrode cross each other in the stepped space or in an area adjacent to the stepped space.

The PDP may further include a phosphor layer formed across the main discharge space and the stepped spaces.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
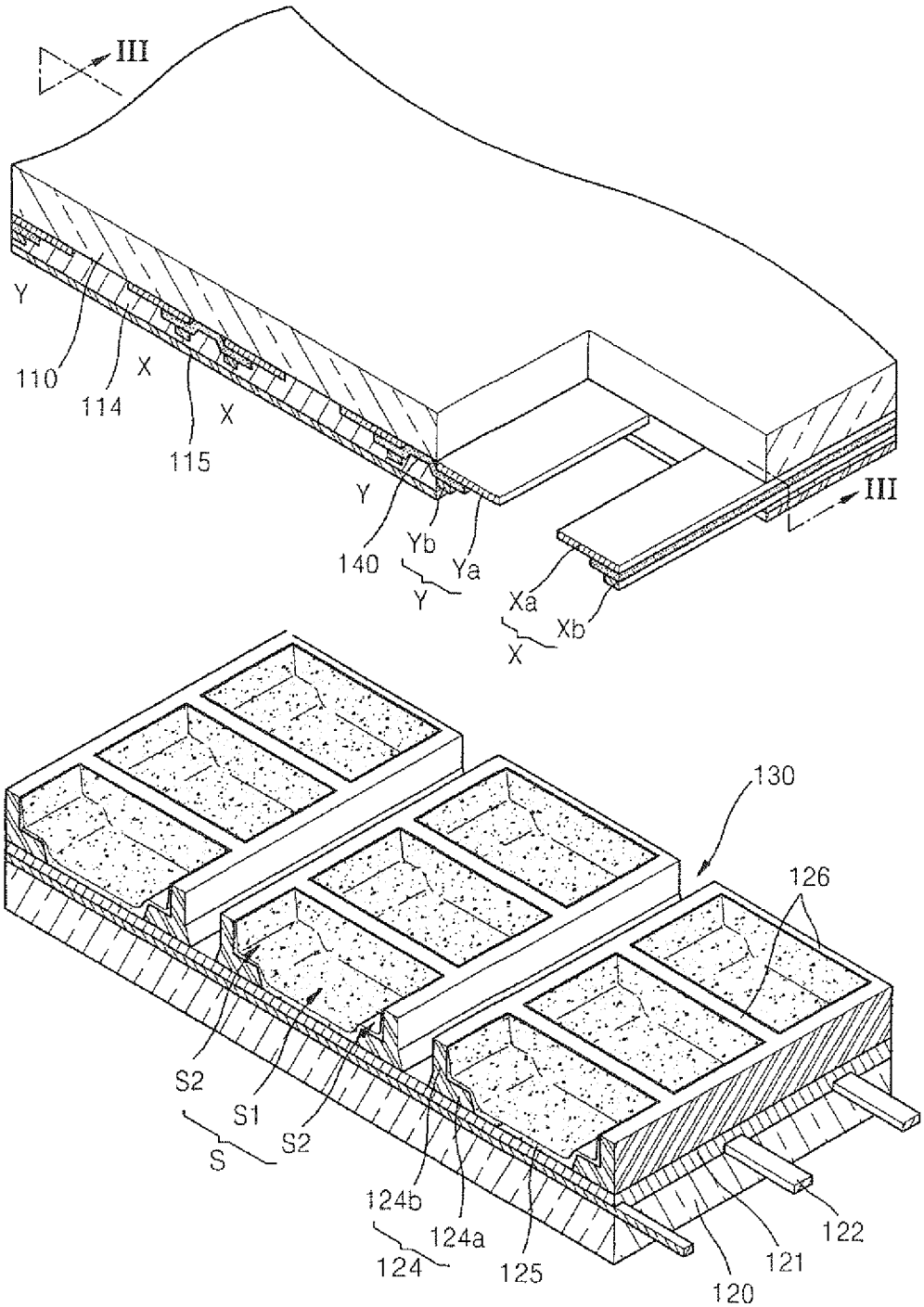
FIG. 1 is an exploded perspective view of a plasma display panel (PDP) according to an embodiment of the present invention.

Reference will now be made in detail to embodiments, examples of which are illustrated in the accompanying drawings, wherein like reference numerals refer to like elements throughout.

FIG. 1 is an exploded perspective view of a plasma display panel (PDP) according to an embodiment of the present invention.

Referring to FIG. 1, the PDP includes a front substrate 110 and a rear substrate 120 which face each other with an interval therebetween, and barrier walls (including horizontal barrier walls 124 and vertical barrier walls 126) which define a plurality of unit cells S. For example, the barrier walls include the horizontal barrier walls 124 extending in one direction and the vertical barrier walls 126 extending so as to cross the extending direction of the horizontal barrier walls 124, and thus define unit cells S which are quasi-rectangular.

For example, each unit cell S denotes a minimal light-emitting unit which includes a discharge electrode pair (X,Y) formed so as to generate mutual display discharge and an address electrode 122 extending so as to intersect with the discharge electrode pair (X,Y). Each unit cell is defined by the horizontal and vertical barrier walls 124 and 126, respectively, and thus forms a light-emission area independent of adjacent unit cells S. Each unit cell S includes a main discharge space S1 and stepped spaces S2 formed on either side of the main discharge space S1. The discharge electrode pair (X,Y) includes a sustain electrode X and a scan electrode Y which generate a display discharge. Each sustain electrode X includes a transparent electrode Xa formed of a phototransparent conductive material and a bus electrode Xb which electrically contacts the transparent electrode Xa and forms a power supply line. Each scan electrode Y includes a transparent electrode Ya formed of a phototransparent conductive material and a bus electrode Yb which electrically contacts the transparent electrode Ya and forms a power supply line. The transparent electrodes Xa and Ya have large widths and thus form a discharge electric field across a large area of each unit cell S. The bus electrodes Xb and Yb have small widths so as not to obstruct visible light, and form a power supply line which transmits a driving signal to the transparent electrodes Xa and Ya.

The discharge electrode pairs (X,Y) may be buried in a dielectric layer 114 so as to be protected from direct collision with charged particles which participate in the display discharge. The dielectric layer 114 may be covered with a protective layer 115 formed of a thin film of MgO. The protective layer 115 may induce secondary electron emission, thereby contributing to discharge activation.

The scan electrodes Y and the sustain electrodes X may alternate with each other. Alternatively, as illustrated in FIG. 1, the scan electrodes Y and the sustain electrodes X may be arranged such that electrodes of the same kind are adjacent to each other in adjacent unit cells S. As illustrated in FIG. 1, a scan electrode Y, a sustain electrode X, a sustain electrode X, and a scan electrode Y are sequentially arranged, and thus a sustain electrode X in a unit cell S may be adjacent to a sustain electrode X in its adjacent unit cell S, and similarly a scan electrode Y in a unit cell S may be adjacent to a scan electrode Y in its adjacent unit cell S. Due to this arrangement of the scan and sustain electrodes, an erroneous discharge in which a display discharge occurs across a cell boundary may be prevented, invalid power consumption may be reduced, and driving efficiency may be increased.

Figure 2:
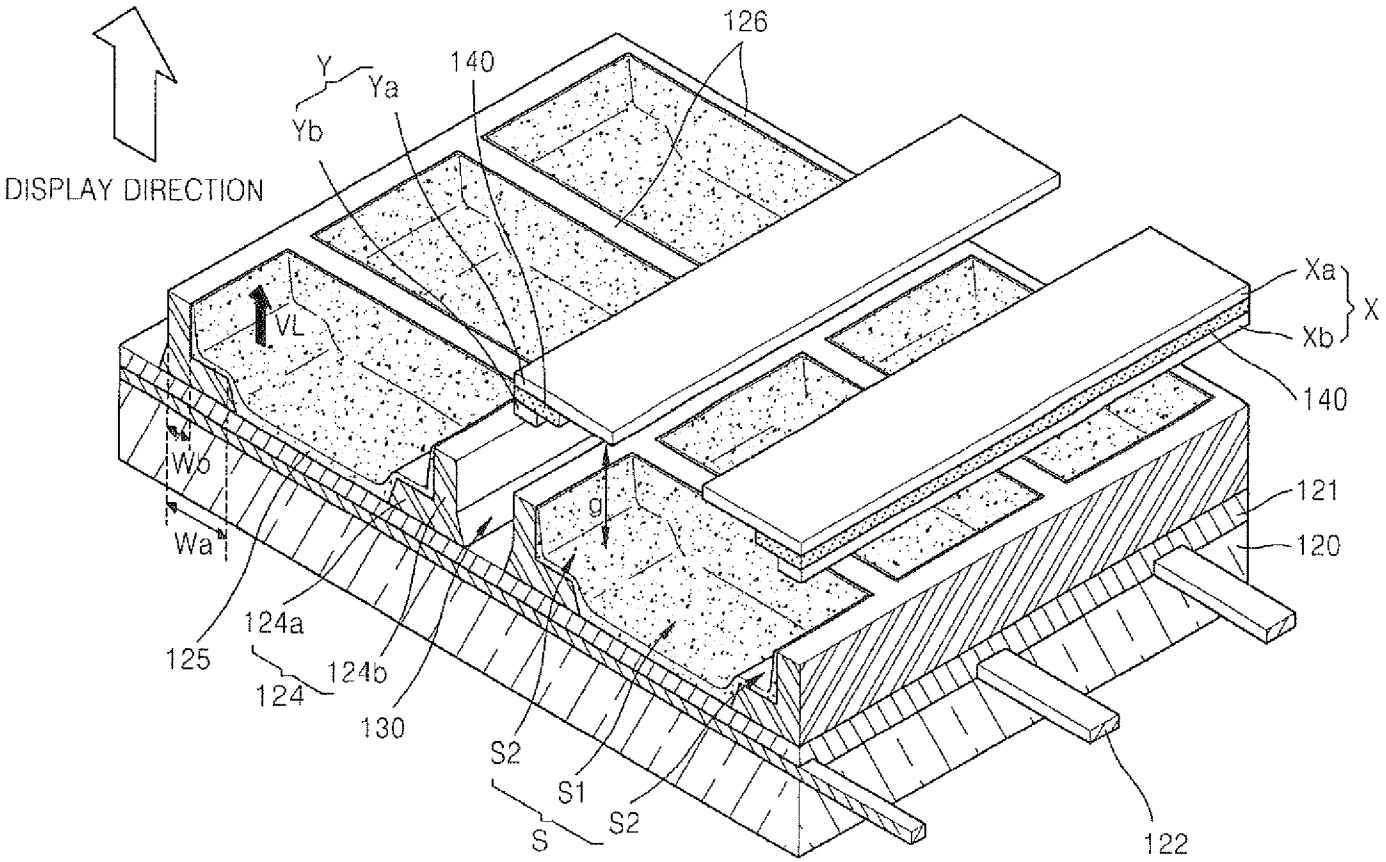
FIG. 2 is a perspective view of a part of the PDP of FIG. 1.

FIG. 2 is an exploded perspective view of a major portion of the PDP of FIG. 1.

Referring to FIG. 2, the address electrodes 122 are arranged on the rear substrate 120. The address electrodes 122 perform an address discharge together with the scan electrodes Y. The address discharge denotes an auxiliary discharge which helps the display discharge by occurring prior to the display discharge, and thus by accumulating priming particles in each of the unit cells S. The address discharge occurs mainly within the stepped spaces S2 existing on the horizontal barrier walls 124 which are stepped. In other words, the scan electrodes Y and the address electrodes 122 cross each other in the stepped spaces S2 or in an area adjacent to the stepped spaces S2, and while a discharge voltage applied to the scan electrodes Y and the address electrodes 122 is concentrated in the stepped spaces S2 via portions of the dielectric layer 114 covering the scan electrodes Y and portions of the horizontal bather walls 124 existing on the address electrodes 122, a high electric field sufficient for discharge firing is formed within the stepped spaces S2. The stepped spaces S2 are not artificially partitioned by other wall structures and instead extend from the main discharge space S1 so as to form a single unit cell S together with the main discharge space S1. Priming particles formed due to the address discharge in the stepped spaces S2 naturally spread to the main discharge space S1 and participate in the display discharge. The stepped spaces S2 are defined by the horizontal barrier walls 124, which are stepped, and have small sizes compared with the sizes of the main discharge space S1.

The address electrodes 122 may be buried in a dielectric layer 121 formed on the rear substrate 120, and the horizontal and vertical barrier walls 124 and 126, respectively, may be formed on a flat plane provided by the dielectric layer 121. The horizontal and vertical barrier walls 124 and 126, respectively, may be the horizontal barrier walls 124 extending in one direction and the vertical barrier walls 126 extending so as to cross the extending direction of the horizontal barrier walls 124, and may form a matrix pattern which defines the unit cells S having quasi-rectangular shapes. For example, the horizontal barrier walls 124 may extend parallel to the scan electrodes Y, and the vertical barrier walls 126 may extend parallel to the address electrodes 122.

The horizontal barrier walls 124 each include the base portion 124*a* having a large width Wa and the protruding portion 124*b* formed on the base portion 124*a* so as to have a small width Wb, and have a stepped shape. The stepped spaces S2 defined by the horizontal barrier walls 124 exist between the scan electrodes Y and the address electrodes 122, and the scan electrodes Y and the address electrodes 122 generate an address discharge in the stepped spaces S2. Portions of the dielectric layer 114 (or the protective layer 115) which cover the scan electrodes Y, and portions of the base portions 124*a* which exist on the address electrodes 122, may form opposed discharge surfaces and generate an address discharge. In other words, since the portions of the dielectric layer 114 covering the scan electrodes Y and the portions of the base portions 124*a* existing on the address electrodes 122 have a high dielectric constant, a discharge electric field may be concentrated in the stepped spaces 82, and opposed discharge may occur in which portions of the lower surface of the dielectric layer 114 and the upper surfaces of the base portions 124*a*, which face each other with the stepped spaces S2 therebetween, serve as a main discharge plane.

In a barrier wall structure of the related art, a discharge occurs between the scan electrodes Y and the address electrodes 122 along a long discharge path corresponding to the height of a cell. However, in the inventive barrier wall structure having the base portions 124*a* formed so as to have a predetermined height toward the scan electrodes Y, the discharge path between the scan electrodes Y and the address electrodes 122 has a decreased gap g from the base portions 124*a* to the scan electrodes Y. Thus, compared to the barrier wall structure of the related art, the barrier wall structure of the invention may produce as many priming particles as the number of priming particles produced in the related art barrier wall structure at an address voltage lower than that used in the related art barrier wall structure, and thus driving power consumption is reduced. When an address voltage equal to that used in the related art barrier wall structure is applied, more priming particles than those produced in the related art barrier wall structure are produced, and thus luminous efficiency increases. The barrier walls 124 and 126 may be formed of a material having a dielectric constant equal to or greater than a certain level so as to foci a high address electric field within the stepped space S2 via the base portions 124*a*, which are parts of the barrier walls 124 and 126. For example, the barrier walls 124 and 126 may be formed of a dielectric material such as PbO, $B_2O_3$, $SiO_2$, or $TiO_2$. A channel space 130 may be defined between adjacent horizontal barrier walls 124 which define different unit cells S, and which extend in a lengthwise direction of the horizontal barrier walls 124. The channel spaces 130 are non-discharge areas where a discharge is not supposed to occur. The channel spaces 130 serve as impurity gas flow paths in an exhaust process where impurity gas existing between the front substrate 110 and the rear substrate 120 attached to and facing each other is exhausted, thereby reducing flow resistance and the tact time of the exhaust process.

The stepped spaces S2 are formed on either side of the main discharge space S1. In detail, the stepped spaces S2 are formed on the sides of a scan electrode Y and a sustain electrode X, respectively. An intensive address discharge occurs using one of the stepped spaces S2 which is on the side of the scan electrode Y, while the stepped space S2 formed on the side of the sustain electrode X establishes an equilibrium of each unit cell S together with the stepped space S2 on the side of the scan electrode Y. By designing the unit cells S, each having a well-balanced shape, a display discharge may have a balanced discharge strength not biased toward any of the scan electrodes Y and the sustain electrodes X and have a symmetrical shape. Therefore, the brightness distribution within each unit cell S may have a nearly symmetrical shape, a light-emitting center may be approximately identical with the geometrical center of each unit cell S, and degradation of the quality of display due to an asymmetrical brightness distribution may be prevented.

A phosphor layer 125 is formed in each unit cell S. The phosphor layers 125 interact with ultraviolet (UV) rays produced as a result of the display discharge, thereby generating visible rays of different colors. For example, red (R), green (G), and blue (B) phosphor layers 125 are formed in the unit cells S according to colors to be displayed, so that the unit cells S are classified into R, G, and B subpixels. Each of the phosphor layers 125 is formed on a surface between adjacent base portions 124*a*, on upper surfaces of the base portions 124*a*, and on side surfaces of protruding portions 124*b* on the based portions 124*a*. In other words, each of the phosphor layers 125 is continuously formed across a corresponding main discharge space S1 and corresponding stepped spaces S2. This phosphor structure may be obtained using a continuous coating process where phosphor paste is coated on a single row of unit cells S at a time. In particular, portions of the phosphor layers 125 formed on the base portions 124*a* are close to the scan electrodes Y and the sustain electrodes X, which generate a display discharge, and thus may be effectively excited. Also, the portions of the phosphor layers 125 formed on the base portions 124*a* are closer to the front substrate 110, which forms a display plane, than the other portions of the phosphor layers 125, and face a display direction, so that visible light VL generated in the phosphor layers 125 may be immediately emitted upward, thereby increasing the efficiency of extracting visible light.

In a related art phosphor structure where a large portion of a phosphor layer is attached to side surfaces of a barrier wall, flowable phosphor paste fails to adhere to the barrier walls due to gravity and flows down, and thus phosphor remaining on the side surfaces has a small thickness or an irregular thickness. In addition, in the related art structure, visible light is discharged in the side surface direction of the barrier walls, and thus light extraction efficiency is lowered. In this embodiment of the present invention, the phosphor layers 125 existing on the upper surfaces of the base portions 124*a*, which are close to the display plane and face the display direction, are formed due to the structure of the stepped barrier walls 124 and 126, and thus phosphor paste remains on and is stably attached to the upper surfaces of the base portions 124*a*. Therefore, the efficiency of extracting the visible light VL emitted upward from the phosphor layers 125 is increased, and light-emitting brightness increases.

Figure 3:
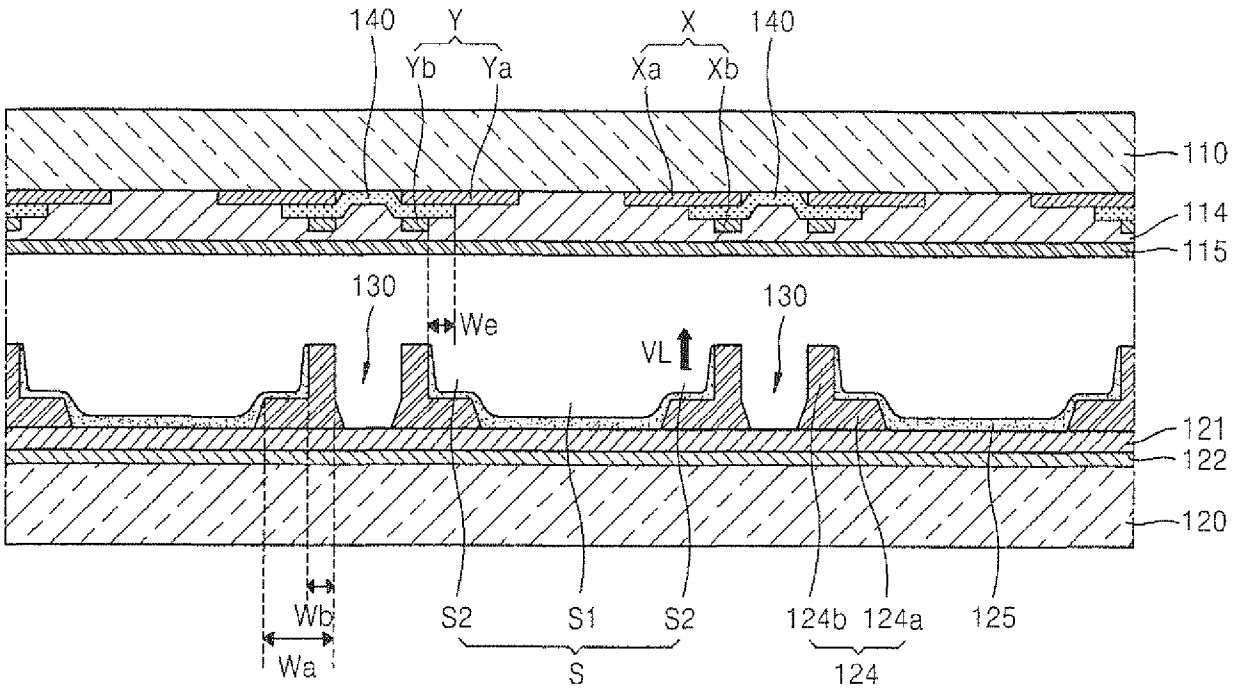
FIG. 3 is a vertical cross-section taken along line III-III of FIG. 1.

FIG. 3 is a vertical cross-section taken along line III-III of FIG. 1.

Referring to FIG. 3, base portions 124*a* each having the large width Wa, and protruding portions 124*b* each having the small width Wb, are disposed on either side of each main discharge space S1, respectively, in between the front substrate 110 and the rear substrate 120, and stepped spaces S2 are formed on either side of the main discharge space S1 due to a stepped surface formed by each base portion 124*a* and each protruding portion 124*b*. The stepped spaces S2 are connected to the main discharge space S1 so as to form a single unit cell S. A channel space 130, wherein discharge is not supposed to occur, is defined between adjacent unit cells S. In detail, the channel space 130 is defined by adjacent protruding portions 124*b* between adjacent unit cells S.

External-light absorbing layers 140 are formed on the channel spaces 130. The external-light absorbing layers 140 include a dark-coloring pigment or a dark-coloring material suitable for absorbing external incident light, and increase the visibility of an image by improving a contrast ratio. The external-light absorbing layers 140 may be disposed between the protruding portions 124*b* which define the channel spaces 130, and may extend to areas over the stepped spaces S2 by passing over the protruding portions 124*b*. The external-light absorbing layers 140 cover only parts of the stepped spaces S2, not the entire areas of the stepped spaces S2, by restricting widths We corresponding to extensions of the external-light absorbing layers 140, which start from the protruding portions 124*b*. The stepped spaces S2 greatly contribute to display light-emission by providing visible light VL extracted efficiently from the portions of the phosphor layers 125 which exist on the base portions 124*a*. Thus, the widths We of the external-light absorbing layers 140 are restricted so that the visible light VL is not blocked. However, as illustrated in FIG. 3, the external-light absorbing layers 140 may extend to the areas over the stepped spaces S2 so as to sufficiently cover the upper surfaces of the bus electrodes Xb and Yb. In particular, if bus electrodes Xb and Yb formed of aluminum (Al) or silver (Ag) which does not include a coloring pigment and which sustains metal luster are used, the external-light absorbing layers 140 need to absorb external light by sufficiently covering the upper surfaces of the bus electrodes Xb and Yb.

Figure 4:
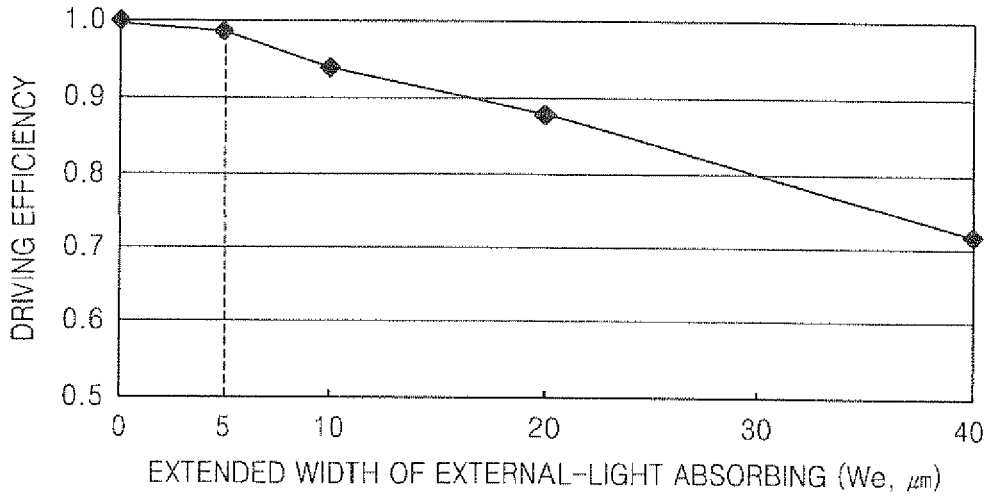
FIG. 4 is a graphic profile showing a variation in driving efficiency versus an extended width of an external-light absorbing layer.

FIG. 4 is a graphic profile showing a variation in driving efficiency versus an extended width of each external-light absorbing layer.

Referring to FIG. 4, the extended width We of each external-light absorbing layer 140 denotes the width corresponding to the extension of the external-light absorbing layer 140, which starts from each protruding portion 124*b*. The driving efficiency is represented as the light-emission brightness per unit consumed power $$\left(\frac{\text{Light-emission brightness (cd)}}{\text{consumed power (W)}}\right),$$

and the light-emission brightness per unit consumed power could be normalized to be 1.0 when the extended width We is 0 (zero). As the extended width We of each external-light absorbing layer 140 increases, the driving efficiency decreases. When the extended width We is 5 μm or greater, the driving efficiency drastically decreases. Accordingly, the extended width We of each external-light absorbing layer 140 may be restricted to be 5 μm or less.

A discharge gas (not shown) as a UV light generator is injected into the unit cells S. The discharge gas may be a multi-element gas in which xenon (Xe), krypton (Kr), helium (He), neon (Ne), and the like, capable of providing UV light through discharge excitation, are mixed at a determined volumetric ratio. A related art high-Xe display panel provides high luminous efficiency, but requires a high discharge firing voltage. Thus, such a related art high-Xe display panel has a limit in practical applications or extended applications when considering various circumstances, such as an increase in driving power consumption and a circuit redesign for increasing rated power. However, in this embodiment of the present invention, wherein a high electric field favorable to address discharge is formed through the base portions 124*a* of the barrier walls, a sufficient number of priming particles for discharge firing may be obtained, and thus a high-Xe plasma display may be implemented without an excessive increase in a discharging firing voltage, thereby drastically increasing luminous efficiency.

Figure 5:
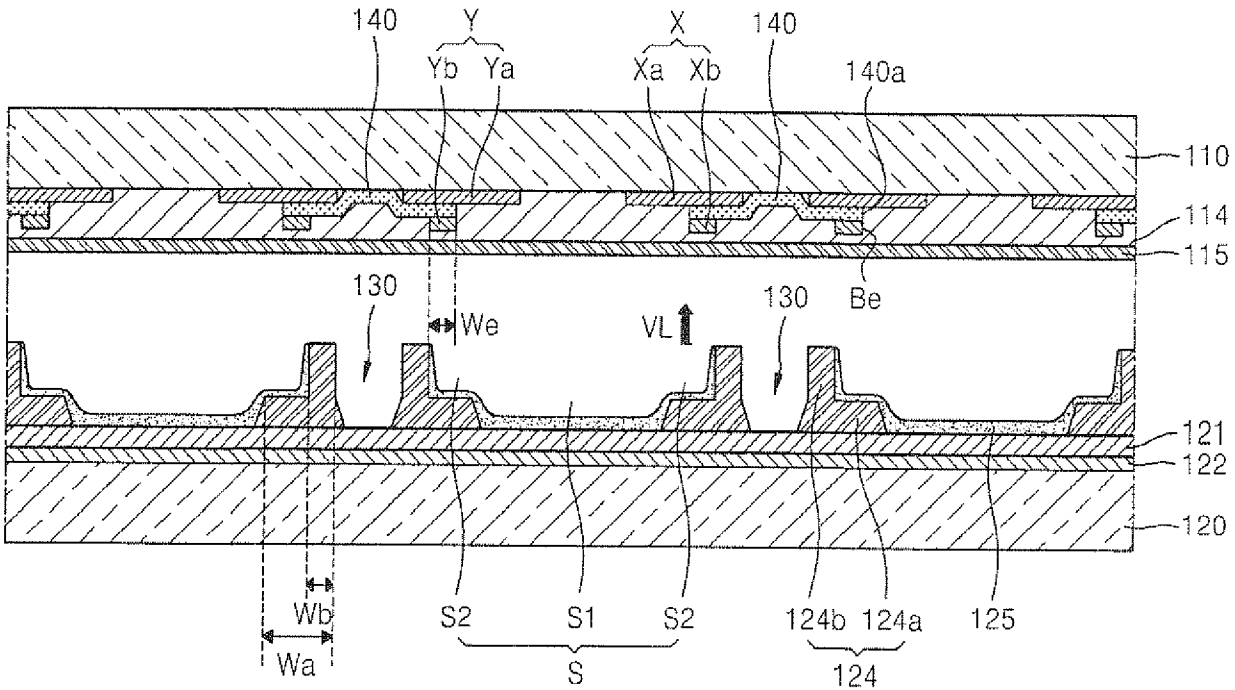
FIG. 5 is a vertical cross-section of a PDP according to another embodiment of the present invention.

FIG. 5 is a vertical cross-sectional view of a PDP according to another embodiment of the present invention.

Referring to FIG. 5, base portions 124*a* each having the large width Wa, and protruding portions 124*b* each having the small width Wb, are disposed on either side of each main discharge space S1, respectively, between the front substrate 110 and the rear substrate 120, and stepped spaces S2 are formed on either side of the main discharge space S1 due to a stepped surface formed by each base portion 124*a* and each protruding portion 124*b*. The stepped spaces S2 are connected to the main discharge space S1 so as to form a single unit cell S. Each pair of a scan electrode Y and a sustain electrode X which generate a mutual display discharge are disposed in each unit cell S, and the scan electrode Y and the sustain electrode X include bus electrodes Yb and Xb, respectively, and transparent electrodes Ya and Xa, respectively. A channel space 130, wherein a discharge is not supposed to occur, is defined by adjacent protruding portions 124*b* between adjacent unit cells S. External-light absorbing layers 140 are formed on the channel spaces 130. The external-light absorbing layers 140 may extend to areas over the stepped spaces S2 via areas over the protruding portions 124*b*. The extended width We of each external-light absorbing layer 140 may be restricted to be 5 μm or less. In contrast, in the embodiment of FIGS. 1 thru 3, ends 140*a* of each external-light absorbing layer 140 may be aligned with ends Be of bus electrodes Xb and Yb. This alignment between the ends 140*a* and the ends Be may be achieved by simultaneously performing a process of forming the external-light absorbing layer 140 and a process of forming the bus electrodes Xb and Yb.

As described above, in a PDP according to one or more of the above embodiments of the present invention, phosphor layers are disposed on the planes which are close to discharge electrodes which perform a mutual display discharge and close to a light extraction plane, so that phosphor is more effectively excited and the visible light extraction efficiency increases. Due to shortening of an address discharge path, low-voltage addressing is possible, and a sufficient voltage margin may be secured. In particular, an external-light absorbing layer formed in a non-discharge area may be designed so as not to affect display light-emission in a high-brightness area where visible light is concentrated with high efficiency, thereby increasing the driving efficiency of PDPs.

It should be understood that the exemplary embodiments described herein should be considered in a descriptive sense only and not for purposes of limitation. Descriptions of features or aspects within each embodiment should typically be considered as available for other similar features or aspects in other embodiments.

What is claimed is:

1. A plasma display panel (PDP), comprising:

a front substrate and a rear substrate which face each other;

at least one dielectric layer disposed on a side of the rear substrate facing the front substrate;

a barrier wall disposed on said at least one dielectric layer and interposed between the front substrate and the rear substrate, said barrier wall comprising base portions arranged only on respective sides of a main discharge space, and protruding portions protruding upwardly from the base portions, respectively, defining stepped spaces on both sides of the main discharge space, wherein the stepped spaces are formed by a combination of the base portions and the protruding portions;

a pair of a scan electrode and a sustain electrode which generate a mutual discharge through the main discharge space;

a channel space defined by outer walls of the protruding portions of adjacent main discharge spaces;

an external light absorbing layer which covers the channel space; and an address electrode which generates an address discharge together with the scan electrode, said scan electrode extending in a first horizontal direction, said address electrode extending in a second horizontal direction perpendicular to the first horizontal direction, and said scan electrode and said address electrode crossing each other, wherein the scan electrode and the address electrode cross each other in the stepped space.

2. The PDP of claim 1, wherein the stepped spaces disposed on both sides of the main discharge space are connected to the main discharge space so as to form a single unit cell, and the channel space is formed between adjacent unit cells.

3. The PDP of claim 2, wherein the channel space is defined by adjacent protruding portions between adjacent unit cells.

4. The PDP of claim 1, wherein the external light absorbing layer is disposed between the protruding portions which define the channel space.

5. The PDP of claim 1, wherein the external light absorbing layer extends to areas over the stepped spaces via areas over the protruding portions, and a width corresponding to an extension of the external light absorbing layer, which starts from each protruding portion, is restricted to be not greater than 5 μm.

6. The PDP of claim 1, wherein the barrier wall comprises horizontal barrier walls which include the base portions and the protruding portions and which are elongated in one direction, and vertical barrier walls elongated to cross the one direction in which the horizontal barrier walls are elongated.

7. The PDP of claim 6, wherein the channel space is formed between adjacent horizontal barrier walls.

8. The PDP of claim 1, wherein:

each of the scan electrode and the sustain electrode comprises a transparent electrode and a bus electrode connected to the transparent electrode, respectively; and ends of the external light absorbing layer are aligned with ends of the bus electrodes.

9. The PDP of claim 1, further comprising a phosphor layer formed across the main discharge space and the stepped spaces.

10. The PDP of claim 1, wherein said at least one dielectric layer comprises two dielectric layers stacked, one on top of another, on the side of the rear substrate facing the front substrate.

11. The PDP of claim 10, wherein the barrier wall is disposed on a topmost one of the two dielectric layers.

* * * * *